US007392729B2

(12) United States Patent
Baddepudi

(10) Patent No.: US 7,392,729 B2
(45) Date of Patent: Jul. 1, 2008

(54) MULTI KNIFE CUTTING DEVICE

(76) Inventor: Gopinath Baddepudi, 301. Saralaramam Apts. 16-11-310-8. Salimnagar, Hyderabad, A.P. (IN) 500036

( * ) Notice: Subject to any disclaimer, the term of this patent is extended or adjusted under 35 U.S.C. 154(b) by 0 days.

(21) Appl. No.: 11/041,085

(22) Filed: Jan. 24, 2005

(65) Prior Publication Data

US 2006/0048618 A1 Mar. 9, 2006

Related U.S. Application Data

(63) Continuation-in-part of application No. 10/042,433, filed on Jan. 10, 2002, now abandoned.

(51) Int. Cl.
*B26D 1/30* (2006.01)

(52) U.S. Cl. ..... 83/607; 83/598; 83/932

(58) Field of Classification Search ..... 83/607–609, 83/598, 599, 932

See application file for complete search history.

(56) References Cited

U.S. PATENT DOCUMENTS

| | | | | | |
|---|---|---|---|---|---|
| 703,588 | A | * | 7/1902 | Ivey | 83/145 |
| 1,031,111 | A | * | 7/1912 | Forster | 83/466.1 |
| 1,183,472 | A | * | 5/1916 | Lewandowski | 83/607 |
| 1,431,692 | A | * | 10/1922 | Schultz | 83/599 |
| 1,582,103 | A | * | 4/1926 | Vitullo | 83/468.94 |
| 1,614,282 | A | * | 1/1927 | Cleary | 30/304 |
| 1,685,245 | A | * | 9/1928 | Russo | 83/578 |
| D85,385 | S | * | 10/1931 | Lowitz | 30/304 |
| 1,910,380 | A | * | 5/1933 | Daum | 83/466.1 |
| 2,240,221 | A | * | 4/1941 | Locker | 83/466.1 |
| 2,552,312 | A | * | 5/1951 | Frank | 83/607 |
| 2,592,657 | A | * | 4/1952 | Cierley | 83/543 |
| 3,076,461 | A | * | 2/1963 | Meek et al. | 83/483 |
| 3,145,743 | A | * | 8/1964 | Cronheim | 83/466.1 |
| 3,231,973 | A | * | 2/1966 | Veskrna | 30/305 |
| 3,704,737 | A | * | 12/1972 | Stout | 99/637 |
| 4,137,807 | A | * | 2/1979 | Schaumberg | 83/651.1 |
| 4,187,865 | A | * | 2/1980 | Burton | 131/250 |
| 4,383,365 | A | * | 5/1983 | Metzigian | 30/304 |
| 4,625,607 | A | * | 12/1986 | Maillez | 83/466.1 |
| 5,950,515 | A | * | 9/1999 | Wetzel | 83/425.1 |
| 6,052,910 | A | * | 4/2000 | Kaebisch, Jr. | 30/301 |
| 6,148,704 | A | * | 11/2000 | Lewis | 83/167 |
| D464,851 | S | * | 10/2002 | Dorion | D7/673 |

* cited by examiner

*Primary Examiner*—Kenneth E. Peterson

(57) ABSTRACT

A manual multi knife cutting device for vegetables and other material of similar structure wherein: the knives are mounted directly in a base guide containing slots and fulcrum bolt for the knives, and an enclosure platform for the vegetables right next to the knife fulcrum. The enclosure location close to the fulcrum reduces cutting loads and it's closed design prevents vegetable sliding. The guides which make up the base using spacers and connecting bolts at the bottom fully support the knives throughout the cutting stroke enabling a smooth cut. Slots extending below the platform enable the knives to go past the cut pieces for a clean cut.

1 Claim, 2 Drawing Sheets

MULTI KNIFE CUTTING DEVICE

CROSS REFERENCE TO RELATED APPLICATIONS

Figure 1:
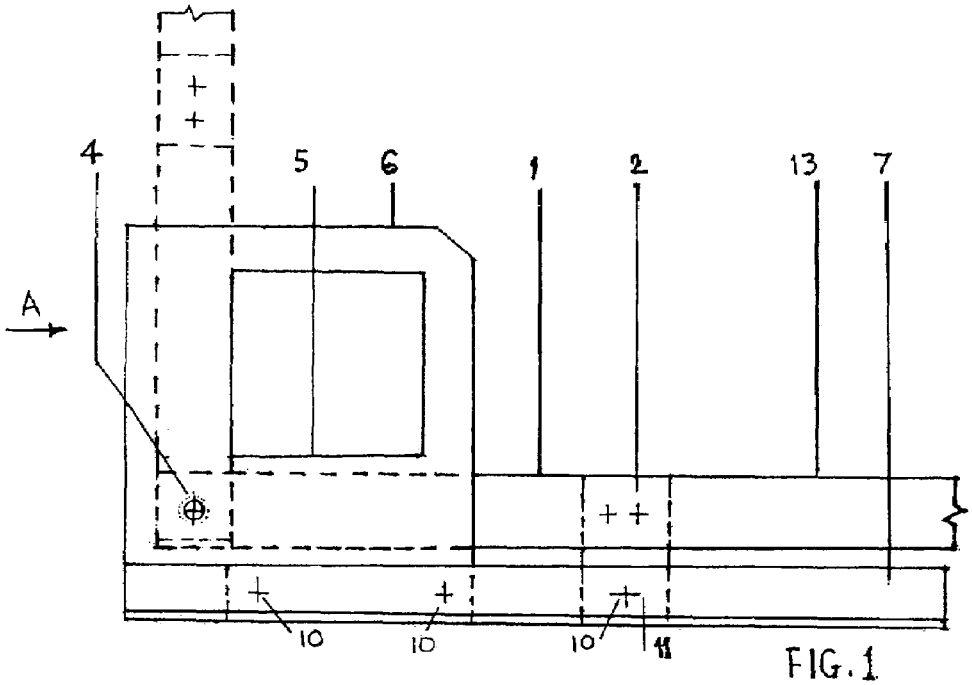

This application is a Continuation In Part application, claiming the benefit of my prior nonprovisional application Ser. No. 10/042,433 of filing date Jan. 10, 2002, under 35 USC. 120, now abandoned.

However I would like to mention that my application no. 98/MAS/2001 dated 5 Feb. 2001 is pending with the Patent office, Chennai, for the same invention. Several improvements and modifications, which are a result of testing the prototypes after Feb. 1, 2001, have been included in the U.S. application Ser. No. 10/042,433.

STATEMENT REGARDING FEDERALLY SPONSORED RESEARCH

Not Applicable

REFERENCE TO A MICRO FICHE APPENDIX

Not applicable

BACKGROUND OF THE INVENTION

The invention described in this application belongs to the field of kitchen gadgets for cutting vegetables which are labor saving. The subject matter of the invention falls under the U.S. patent classification "083-CUTTING".

I am listing below some prior art cutting devices with US patents which I came across during a search in the database.

| U.S. Pat. No. | Title |
|---|---|
| 6,148,704 | Vegetable cutting device |
| 6,052,910 | Vegetable cutting device |
| 5,950,515 | Apparatus for slicing vegetables |

There are some more patented multiple knife cutting devices, a list of which is enclosed. Problems in the prior art multi knife devices are as follows.

Buckling of knives under load, vegetables remaining stuck between the knives, sliding of vegetables, increase in the load and due to knife frames and consequent reduction in the lever advantage. It may also be noted that though there are patents for multiple knife cutting devices, the devices are not a common sight in the market. I have not seen any in the supermarkets.

The device, which I have invented, is structurally and functionally different from these prior art devices.

The components used in my invention are rectangular plate elements, knives, handles, fasteners, plastic parts etc, which are items in common use. They have been designed and assembled in a novel way to obtain a new and effective device for cutting vegetables.

I was motivated to invent a more productive multi knife device after seeing the drudgery inherent in cutting vegetables with a single utility knife.

BRIEF SUMMARY

The invention "Multi knife cutting device" comprises a novel base guide and three pairs of knives directly mounted on the base guide. The object of the invention is to provide a trouble free multi knife vegetable cutting device which is time and labor saving. The novel design features which make it different from prior art are detailed in the section "Detailed description of the Multi knife cutting device".

The best embodiment will be described in the following pages.

The advantages of the new invention are:

The increase in productivity; the time and effort saving and use of lever action to gain mechanical advantage.

The novel design features in the invention have created a better device as described below.

The buckling or misalignment of knives is minimized due to comprehensive guiding by new type of guide elements. The cutting effort is reduced by reducing the load arm. Sliding of vegetables is prevented. The cut pieces do not remain stuck between the knives after the cut.

BRIEF DESCRIPTION OF DRAWING VIEWS.

| Sheet no. | FIG. NO. | Details |
|---|---|---|
| 1/2 | 1 | Elevation view. Dotted lines show knife starting position. |
| 1/2 | 2 | End view of base guide, without knives, direction A. |
| 2/2 | 3 | Plan View of device, knife handle arrangement, Knives in horizontal position. |

DETAILED DESCRIPTION OF THE MULTI KNIFE CUTTING DEVICE

This is a new vegetable cutting device using multiple knives with several innovative features, making it distinct from any other cutting device. These features will be described at the end of this section. The details of the drawing figures are given below.

FIG. 1. Elevation view, knives horizontal, dotted lines show knives in vertical position.

Figure 2:
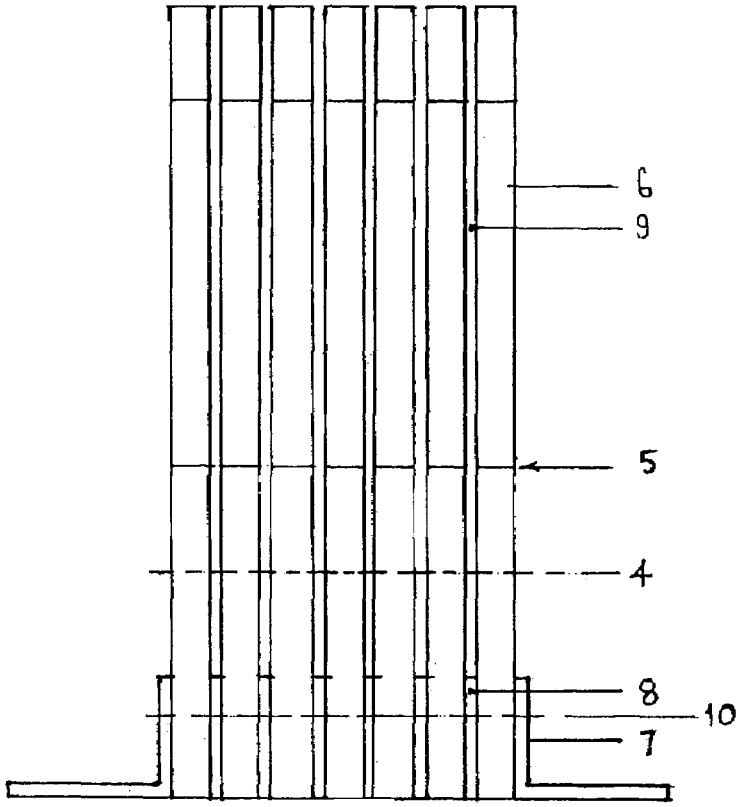

FIG. 2. End view in direction A of FIG. 1, of base guide without knives, FIG. 3. Plan view of device and the knife handle arrangement, knives horizontal.

PART LIST

| Part no. | Name | Quantity | Material | Dimension, mm |
|---|---|---|---|---|
| 1 | Knife | 6 | SS 420 | 1 × 24 × 160 |
| 2 | screw | 12 | Steel | 4 dia |
| 3 | handle | 1 | Al/laminate | 6 × 24 × 160 |
| 4 | fulcrum screw | 1 | Steel | 4 dia |
| 5 | Vegetable enclosure | 1 | Aluminum/ laminate | 60 × 60 |
| 6 | Guides | 7 | Aluminum/ Laminate | 6 × 129 ht |
| 7 | base angle | 2 | Aluminum | 2 × 20 × 25 |

-continued

PART LIST

| Part no. | Name | Quantity | Material | Dimension, mm |
|---|---|---|---|---|
| 8 | Spacers | 6 | Laminate plastic | 2 × 20 × 76 |
| 9 | Slots for knives | 6 | | 2 wide |
| 10 | screws | 12 | Steel | 4 dia |
| 11 | End stop | 1 | Wood/plastic | |
| 12 | U type handle | 1 | Aluminum | 3 × 24 × 165 |
| 13 | U type handle | 1 | Aluminum | 3 × 24 × 175 |

Construction Details of Multi Knife Cutting Device.

Figure 3:
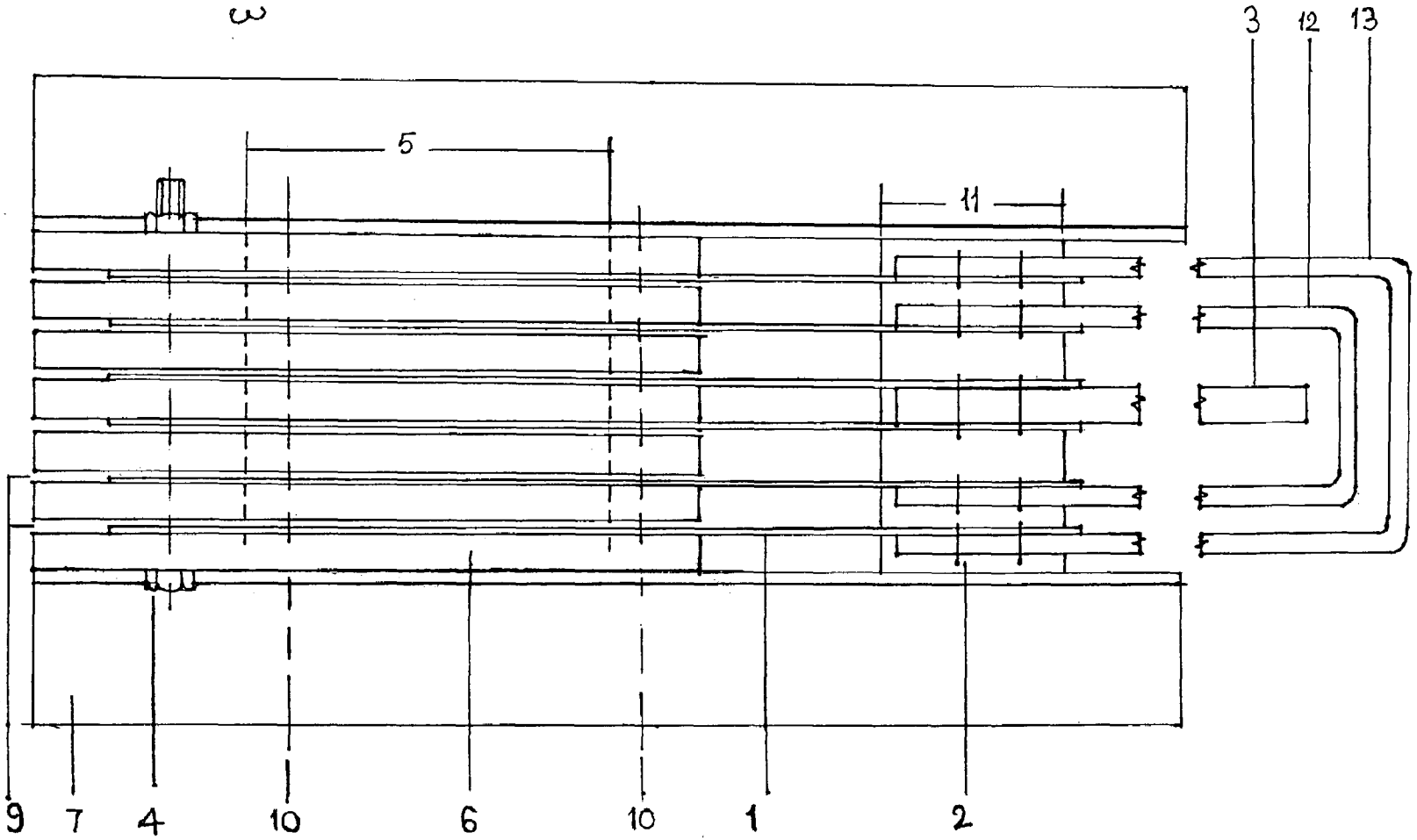

The appearance of the device is shown in FIGS. 1,2 and 3.

The materials and dimension details are given in the part list above.

The multi knife cutting device comprises of two sub assemblies, base guide with part numbers 6,7,8,10 and the cutting means with part numbers 1,2,3,4,12, 13.

Base Guide:

This is the main component of the device having a novel design and multi function capabilities. Part 6 is a guide made of 6 mm thick aluminum plate or laminated plastic sheet and it has a rectangular shape, with 60×60 mm square cutout in the middle portion as seen in FIG. 1. The guide also has a fulcrum hole to receive the fulcrum screw (4), for mounting the knives to the left of the square cutout as seen in FIG. 1. Seven numbers guide are assembled together, with two base angles (7) one each on either side at the bottom edge of the guide and included in the assembly are six spacers part 8 inserted between the seven guides at the bottom edge. The spacers create six 2 mm wide slots (9) between the seven guides. Screws 10 are used for the above assembly.

After the assembly as explained above, the 60×60 cutouts in all the guides together form an enclosure called vegetable enclosure part 5. The vegetables can be placed inside the vegetable enclosure and the vertical wall at the back (away from the fulcrum hole) provides solid support to prevent sliding of the vegetables. The fulcrum holes in part 6 are all aligned after assembly and ready for mounting the cutting means through part 4 fulcrum screw.

Cutting Means, Part Numbers 1,2,3,4,12,13:

The cutting means includes six knives part 1 with fulcrum hole at one end and holes for handles at the other end. The six knives are formed into three pairs. Assuming that the knives are numbered in sequence from 1 to 6, 1 and 6 is the outer pair, 2 and 5 is the middle pair, 3 and 4 is the inner pair. The inner pair is fitted with a straight handle part 3, the middle pair with U type handle 12 and the outer pair with U type handle 13. Part 2 screw is the connecting element between the knives and handles.

The knives are connected to the base guide by direct mounting, that is without using a knife frame. The six knives part 1 are located in the six slots (9) of the base guide matching the fulcrum holes of both. The knives are connected to the base guide with the fulcrum screw (4) Washers are used between the knife and the guides in the fulcrum area so that the knives will move without play.

Movement of Knives:

The knives move from the vertical to horizontal position in pivot action for the cutting stroke. They are stopped in the horizontal position by the end stop part 11 fitted between the two angles (7) in a location matching with the knife and handle joint in the horizontal position. The handles of the knives act as levers with respect to the fulcrum in the base guide.

Functional Description.

The device is placed on a flat surface as shown if FIG. 1.

The three pairs of 6 knives (1) are taken to the vertical position which is the starting position for cutting. The vegetables are placed in the vegetable enclosure (5). The knives are pushed clockwise by holding the three handles mentioned above together at the end, to gain maximum lever advantage. The stroke comes to an end in the horizontal position after cutting the vegetables in the enclosure, entering the guide slots below the enclosure, touching the end stop part 11. As the knives have traveled past the vegetables after cutting them. The cut pieces are lying free on the platform and can be removed by pushing with a wooden piece or by tilting the whole device to the right.

Now the device is ready for the next cycle of the cutting operation.

This embodiment is the best mode because of the following.

It is designed to cut a full potato of section 50×60 mm into slices and then slices into fingers. For the first operation of slicing, the outer two pairs of knives are to be used first for cutting while the inner pair of knives is pressing the potato in the middle. The inner knives can be pushed down immediately after the outer knives become horizontal. The procedure is same for cutting slices into fingers. For dicing 6 to 8 fingers of potatoes, all six knives can be used at a time.

For cutting green vegetables like 6 numbers Okra or French beans at a time all the three pairs having a total of 6 knives can be used simultaneously saving both time and effort. The cutting is smooth and the device is convenient to use.

The design features of this invention which are novel and make it different from prior art references are explained below.

The base guide structure comprising of parts 6, 7, 8, 10, FIG. 1.2

The construction of the base guide has been described in an earlier section. It is a novel design to combine seven plate like elements to make a versatile structure for this device.

The device is compact, sturdy and easy to manufacture.

The various capabilities of the multi function base guide structure are listed below:

a) Direct mounting of the knives on the fulcrum hole through a fulcrum screw;

b) The slots housing the knives and preventing knife misalignment as knives cannot go out from the slots, c) Guiding the full length of the knife as the guides are present on both sides from beginning to the end of knife travel; This minimizes knife side bending and misalignment caused by loads due to simultaneous cutting resulting in the compression of the vegetables between the knives. The knife portion which passes through the enclosure is not guided but this is kept to a minimum and the guiding extends beyond the enclosure again.

d) Provision of the vegetable enclosure within the guides, close to the knife fulcrum.

e) Functioning as a base for the device, in addition to all other functions.

Vegetable Enclosure Dart 5—FIG. 1

As seen in FIG. 1, the vegetable enclosure is formed within the base guide assembly, adjacent to the knife fulcrum. This feature reduces considerably the distance from the fulcrum to the cutting load thus increasing the mechanical advantage.

The enclosure effectively stops the vegetables from sliding during cutting as they are supported by the vertical back wall of the enclosure. This feature enables cutting to start from the vertical position of the knife. In the prior art the supports are not present or if present, not of sufficient size to stop sliding.

As the enclosure is closed on four sides, the vegetables become self supporting. There is no need to hold them during cutting.

The Guide Slots Below the Vegetable Enclosure.

The advantage of these slots in clearing the cut pieces from the knives is explained in the section on functional description. The end stop, limiting the travel of the knives in horizontal position ensures that the knife edges are saved from damage, caused by the edges touching the bottom of the base structure.

Mounting of Knives and Cutting Action.

In this invention, a separate frame to hold the knives in place has not been used. The knives are mounted directly on the base guide using only a fulcrum screw part 4, FIG. 1. This is a novel feature which reduces the distance between the fulcrum and the load, increasing the mechanical advantage.

The direct mounting makes the device simple and compact.

It also facilitates the possibility of using 2, 4 or 6 knives at a time, as the knife handles are joined to form three separate pairs as shown in FIG. 3.

This is very useful when cutting hard and large vegetables.

The absence of knife frame increases access to the device and also eliminates the fouling of large vegetables with the long side members of the knife frame.

All the above features make the device compact, sturdy, easy to use and very effective in making smooth cuts with multiple knives.

Cutting Action

In this invention the cutting action is very efficient as compared to multiple knife cutting devices of prior art. In the existing devices with pivot action of knives, the vegetables do slide till the knives form an angle closer to 45 degrees so that the knives can press the vegetables down. This happens as the small prongs or pegs cannot resist the force applied to the handle for cutting.

In the new invention, the vegetables are boxed in a vegetable enclosure 5 which has a solid back wall supporting the vegetables against sliding. The knives in vertical position, are adjacent to the enclosure touching the vegetables. When the knife handles are pulled for cutting, they start cutting the vegetables even from vertical position as the vegetables are very close to the knives in the starting position and the vegetables are prevented from sliding. This cutting action described above is not present in prior art due to larger distance between the vegetable and fulcrum caused by knife frame and the absence of tool proof anti sliding structures.

Alternate Mode of the Cutting Means.

In the preceding description, the cutting means of the Multiple knife cutting device comprised of six knives (1) formed into three pairs namely knife numbers [1,6], [2,5], [3,4], all the pairs being mounted on fulcrum (4). In this mode when simultaneous cutting with all six knives is performed, the knife edges are all in the same plane or level as the knives and handles are adjacent to each other all along the length. This location of the knives in the same level during cutting, has some problems which will be described later. Now the alternate mode of the location and assembly of knives will be described which has some benefits over the previous method.

The following are the relevant drawings for this mode.

FIG. 4. Elevation view of the device without the angles (7).

FIG. 5. Detail of the assembly of three knives in the guide slots,

FIG. 6. Section AA of FIG. 4—The end view of knives and guides.

Details of the Knife Assembly.

The same part numbers used in FIGS. 1,2,3 of the original application are used in the new figures also.

In using the new mode of the knives, there is no change in the base guide (6,7,8,10). The angle (7) is not shown in the new drawings as it is not essential to understand the new mode and the clarity for other parts will improve. In this mode the six knives (1) of the earlier mode, are split into two groups, three numbers of part 1 and three of part '1*a*'. Part '1*a*' has an offset fulcrum hole as seen in FIG. 4 and there is no other difference in their dimensions. The slots (9) between the guides (6) are numbered 1 to 6 serially from the left. The three knives (1) are straight knives and are mounted in slot nos 1,3,5 on the fulcrum (4) and the handles are joined together as shown in FIG. 5. The three knives with offset fulcrum (1*a*) are also mounted on fulcrum {4), in slot nos 2,4,6 resulting in a position above the knives (1) as Shown in FIGS. 4,6, the handles being joined together similar to knives (1). The offset fulcrum of the knives (1*a*) facilitates this difference in the plane/position/longitudinal axes of the two groups of knives. As explained above there are two groups of knives with common handles at two different levels one above the other. As they are on a common fulcrum (4), when they are moved by hand holding both the handles, the two groups of knives move with pivot action on the fulcrum but at two distinct planes/levels. There is no other difference in the construction of the device.

The operation of the device for cutting is the same as before. The vegetables are kept in the enclosure (5) and the knives are pressed onto them, with the knives coming to rest in the slots below the vegetables.

Novel Features and Benefits of the New Mode of the Cutting Means.

In the first mode as explained earlier the knives are in the same level during simultaneous cutting with six knives. This creates higher cutting resistance during slicing of whole potatoes due to the close gap between adjacent knives, resulting in higher cutting loads, non uniform slicing caused by knife bending and knife fouling with the guide walls in the enclosure(5). This is the reason why a two step cutting is recommended in the first mode for whole potato slicing.

In the new alternate mode of knife location and grouping, the gap between adjacent knives becomes double for the same slice size, as the knives are located in alternate slots and at different levels. This reduces the cutting loads dramatically resulting in smooth cutting. In this mode whole potatoes of 50×60 mm section can be sliced simultaneously with all six knives without problems. The cutting effort for other vegetables is also greatly reduced which is highly desirable. These are novel features which are not present in the prior art.

Other Design Variations with the Same Principle

The description of the embodiment in the preceding pages is considered as an illustration of the design principles of the invention and is not an exhaustive collection of all the variations. The invention is not limited to the embodiment described in this application. All feasible modifications and variations within the scope of the invention may be resorted to in due course.

I claim:

1. A multi knife cutting device comprising;

a base guide assembly containing seven rectangular sheet guide elements with spacers in between said guide elements at a bottom of said base guide assembly, and support angles on either side of said guide elements at the bottom of said base guide assembly, said base guide assembly containing a vegetable enclosure in the middle in the form of a square cut out in all of said guide elements, for boxing in the vegetables, said base guide containing a fulcrum hole between a guide edge and said vegetable enclosure, below a vegetable enclosure bottom level, a cutting means of six knives mounted directly on the said fulcrum hole using a fulcrum bolt, locating said six knives respectively in between said seven guide elements, a handle arrangement in which the innermost two knives are connected to one handle, the outermost two knives are connected to a first U-shaped handle and the remaining two knives are connected to a second U-shaped handle, the three pairs connected as described, being free to pivot one pair at a time or two or three pairs at a time, and an end stop located between the said angles to limit the knife travel to a horizontal position.

* * * * *